United States Patent [19]

Oshima

[11] Patent Number: 4,967,116

[45] Date of Patent: Oct. 30, 1990

[54] SPARK PLUG HAVING HEAT- AND CORROSION-RESISTANT SURFACE

[75] Inventor: Takafumi Oshima, Nagoya, Japan

[73] Assignee: NGK Spark Plug Co. Ltd., Nagoya, Japan

[21] Appl. No.: 280,314

[22] Filed: Dec. 6, 1988

[30] Foreign Application Priority Data

Dec. 10, 1987 [JP] Japan ..... 62-187218[U]

[51] Int. Cl.[5] ..... H01T 13/06

[52] U.S. Cl. ..... 313/141; 313/11.5

[58] Field of Search ..... 313/141, 11.5, 355

[56] References Cited

U.S. PATENT DOCUMENTS 1,164,082 12/1915 Gallant ..... 313/11.5 X
3,492,156 1/1970 Ayoub ..... 313/355
3,857,145 12/1974 Yamaguchi et al. ..... 313/141 X

OTHER PUBLICATIONS

"Mekki Kyohon" (Textbook of Plating, Compiled by Electroplating Study Group), published Sep. 20, 1986, (excerpt) in Japanese with English translation.

*Primary Examiner*—Sandra L. O'Shea
*Attorney, Agent, or Firm*—Wegner & Bretschneider

[57] ABSTRACT

A metal body has a heat- and corrosion-resistant surface which is composed of a layer of nickel plating applied to a surface of a metal base and an electrolytic chromate film formed over the nickel plating. Preferably, the chromate film has a thickness of 3 μm or less. The chromate film may have a color imparted upon its formation by an electrolytic chromate treatment. A metal sheel of a spark plug may be mentioned as one example of the metal body.

7 Claims, 1 Drawing Sheet

SPARK PLUG HAVING HEAT- AND CORROSION-RESISTANT SURFACE

BACKGROUND OF THE INVENTION (1) Field of the Invention:

This invention generally relates to a surface treatment of a metal body which is used under high-temperature and high-pressure conditions and is required to have both heat and corrosion resistance, for example, a spark plug, sensor or the like. In particular, this invention is concerned with a metal body with a heat- and corrosion-resistant surface which comprises two layers formed one over the other by plating techniques respectively.

(2) Description of the Related Art:

Low carbon steel is generally used in metal bodies used at high temperatures and pressures, for example, spark plugs and the like. In order to meet the requirement for heat and corrosion resistance, the metal surfaces have heretofore been subjected either to zinc plating and subsequent chromate finish or to nickel plating in practice.

Among such conventional metal bodies, there are metal bodies obtained by applying a zinc plating treatment to steel. Since zinc plating is lower in standard electrode potential than steel, zinc plating acts as an anode so that the zinc plating selectively undergoes corrosive oxidation. The zinc plating layer and steel however retain their electrical contact, whereby corrosion to the steel does not proceed and good corrosion resistance is hence exhibited. In the case of a substitute gas such as natural gas, sewage digestion gas or pyroligneous gas, components discharged as combustion products react with water, thereby forming a liquid whose pH is on the acid side. A metal body is therefore exposed to such an acidic liquid under high-temperature conditions. Regarding the surface treatment of a metal shell of a spark plug or the like, zinc plating allows red rust to occur in a rather short period of time no matter what chromate treatment is applied to its surface, because zinc itself is reactive with acids. It is also required to achieve dimensional reduction of plugs in order to meet the demand for engines having higher performance and a smaller size. It may hence be contemplated of reducing the diameter of a threaded portion of a plug with a view toward meeting the above requirement. Zinc which is the plating itself is however soft and hence acts as a solid lubricant. A considerable stress is therefore applied to the base material even when the torque applied is small, so that the base material is liable to breakage. Regarding heat resistance on the other hand, zinc plating develops discoloration at 300–400° C. It is hence impossible to apply a so-called hot crimp structure, which involves heating and crimping of a thin wall portion of the metal shell.

On the other hand, nickel plating can exhibit superb corrosion resistance owing to the inherent properties of nickel itself provided that the surface is covered completely. Since a spark plug or the like is screwed in at its threaded portion, it is indispensable to reduce the thickness of the plating. Further, pinholes, cracks and the like occur easily and the corrosive liquid tends to penetrate through them. Nickel having a high standard electrode potential therefore acts as a cathode, so that its red rusting proceeds fast. With the foregoing in view, it may be contemplated of applying nickel plating in two or three layers or chromium plating to prevent pinholes and the like. In the former approach, the thickness of the plating cannot however be increased to any significant extent when the fitting readiness of the threaded portion is taken into consideration, and moreover the application of such additional layers of plating results in an increase in the fabrication cost. In the latter approach on the other hand, chromium plating may not be able to sufficiently follow deformations of the base material in a crimping step and may hence be separated from the base material. Regarding corrosion resistance to acidic liquid and heat resistance, chromium plating exhibits excellent properties compared to zinc plating. In addition, chromium plating also assures sufficient breaking strength for threaded engagement.

SUMMARY OF THE INVENTION

An object of this invention is therefore to improve the above-mentioned drawbacks of conventional metal bodies of the above sort, and more specifically to economically apply a surface having excellent heat and corrosion resistance to a metal base without impairing the inherent strength of the metal base, such as breaking strength, even when applied to a threaded portion.

In one aspect of this invention, there is thus provided a metal body having a heat- and corrosion-resistant surface. The surface comprises a layer of nickel plating applied to a surface of a metal base and an electrolytic chromate film formed over the nickel plating. Preferably, the chromate film has a thickness not greater than 3 μm. The chromate film may have a color imparted upon its formation by an electrolytic chromate treatment.

Owing to the layer of nickel plating and the electrolytic chromate film coated in a laminated relation on the base material, damages to a threaded portion or the like can be avoided since the breaking strength of the nickel plating is comparable with the base material. Moreover, this excellent strength can be retained even at high temperatures and high pressures owing to the superb corrosion and heat resistance of the electrolytic chromate film. In addition, the electrolytic chromate film can be applied to a considerable thickness. This is particularly so when the electrolytic chromate film is in a colored form. Pinholes, cracks and the like formed in the layer of nickel plating can therefore be effectively covered. In particular, the above surface treatment is extremely effective for the metal shell of a spark plug.

By the application of a layer of nickel plating and a electrolytic chromate film, especially, a colored electrolytic chromate film to a base body, the base body can sufficiently withstand even when used under conditions where it is exposed to high temperatures and high pressures. Moreover, the layer and film can be applied at a relatively low cost. The above treatment therefore has excellent advantages that the reliability of the final product is improved. The above surface treatment can thus show excellent rust-preventive effects when applied to the metal shell of a spark plug for a gas engine making use of natural gas, sewage digestion gas, pyroligneous gas or the like which tends to cause rusting.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION

Figure 1:
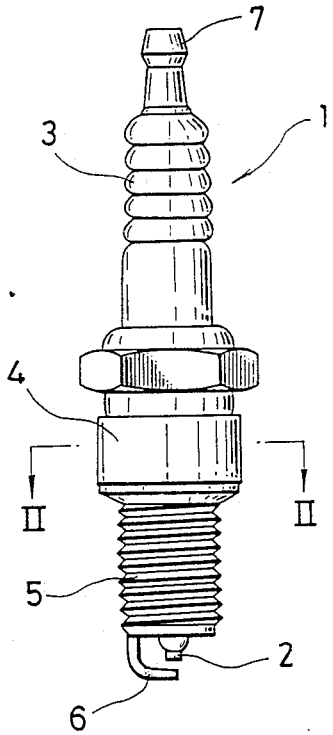
FIG. 1 is a front elevation of a spark plug according to one embodiment of this invention.
Figure 2:
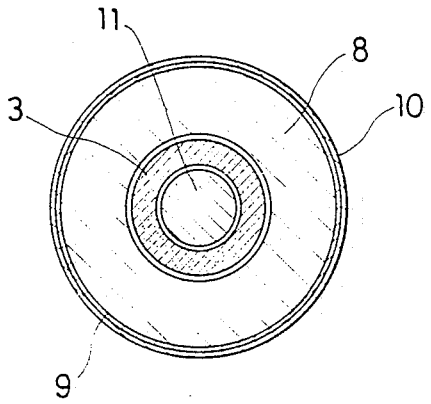
FIG. 2 is a transverse cross-section taken in the direction of arrows II—II of FIG. 1.

The spark plug according to one embodiment of this invention will hereinafter be described with reference to FIGS. 1 and 2. The spark plug is generally indicated at numeral 1, and is equipped with a terminal electrode 7, an insulator 3, a metal shell 4, a threaded portion 5 adapted to threadedly secure the plug 1 to an engine head of an internal combustion engine or the like, and on a side opposite to the terminal electrode 7, a center electrode 2 and a ground electrode 6. As shown in FIG. 2, the metal shell 4 is provided with a nickel plating layer 9 formed by an electrolytic or electroless process on the surface of a steel portion 8 shaped as the base of the metal shell 4. The nickel plating layer 9 has been subjected to an electrolytic chromate treatment by successively treating the layer 9 through degreasing, rinsing, activating and rinsing steps and then immersing same, for example, in a chromate-containing solution employed for color chromate treatment for zinc plating or used for chromium-based black plating, whereby the surface of the nickel plating layer 9 is coated with an electrolytic chromate film 10 whose composition is generally represented by $xCr_2O_2 \cdot yCrO_3 \cdot H_2O$. Here, the thickness of the electrolytic chromate film 10 may be not greater than 3 μm, preferably, 0.1–2 μm as opposed to the nickel plating layer 9 whose thickness ranges from 3 μm to 8 μm. Desirably, the chromate film 10 is applied as a color electrolytic chromate film. If the film 10 is thicker than the above-mentioned upper limit, it interferes with the matching base, namely, the engine head upon threaded engagement of the threaded portion 5 so that the film 10 is susceptible to peeling or separation. After the coating of the surface of the nickel plating layer 9 with the electrolytic chromate film 10, the resultant spark plug was rinsed and then dried to complete the surface treatment. The corrosion resistance of the metal shell of the spark plug, whose surface treatment had been conducted in the above manner, was tested by dipping the metal shell in an electrolyte solution (20% saline). It took as long as 100–150 hours until red rust was developed (see Table 1). Another corrosion test was also conducted, in which the spark plug was left over at 90° C. in an environment of high temperature and strong acidity, namely, in an oxidative environment containing nitrate groups and having pH 2 like drain water. No rust was developed even after passage of 48 hours or longer (see Table 2). In the case of conventional spark plugs, even those plated with nickel were rusted in about 40 hours or so. The breaking strength of the spark plug according to this invention was also measured. Based on a spark plug applied with zinc plating, the breaking strength data of spark plugs with a conventional plating ranged from 100 to 120 while the breaking strength of the spark plug according to this invention was as great as about 150 and was hence substantially comparable with those (about 160) of spark plugs not applied with plating (see Table 3). Further, the spark plug of this invention also exhibited marked heat resistance, whereby its excellent overall properties were demonstrated clearly (see Table 4). Incidentally, designated at numeral 11 in FIG. 2 is an inner electrode portion of the center electrode 3.

TABLE 1

| Plating | Time until development of white rust | Time until development of red rust |
|---|---|---|
| Zinc plating with color chromate treatment | 24–100 hrs | 250–750 hrs |
| Nickel plating | Not developed | 12–48 hrs |
| Nickel plating + electrolytic chromate (Invention Example) | Not developed | 100–150 hrs |

TABLE 2

| Plating | Time until development of white rust | Time until development of red rust |
|---|---|---|
| Zinc plating with color chromate treatment | Not developed | 5–10 hrs |
| Nickel plating | Not developed | 30–40 hrs |
| Nickel plating + electrolytic chromate (Invention Example) | Not developed | No red rust developed in 48 hrs |

TABLE 3

| Plating | Hardness of plating | Breaking torque (based on zinc plating) |
|---|---|---|
| Zinc plating with color chromate treatment | Hv 60–80 | 100 |
| Lead plating | — | 105 |
| Copper plating | — | 105 |
| Nickel plating + chromium plating | 600 | 120 |
| Chromium plating | 600–1000 | 120 |
| Nickel plating | 250–300 | 150–160 |
| Nickel plating + electrolytic chromate (Invention Example) | 250–300 | 150–160 |
| Without plating | — | 160 |

TABLE 4

| | Corrosion resistance | | Strength of threaded portion at its proximal end | Heat resistance | Cost, appearance |
|---|---|---|---|---|---|
| | Saline environment | Strongly acidic environment | | | |
| Zinc plating treated with color chromate | Excellent | Poor | Poor | Poor | Excellent |
| Nickel plating | Poor | Good | Good | Good | Good |
| Nickel plating + chromium plating | Good | Excellent | Fair | Good | Poor |
| Nickel plating + electrolytic chromate treatment (Invention Example) | Good | Good | Good | Good | Excellent |

Needless to say, the application of this invention is not limited to metal shells of spark plugs as exemplified above. This invention is also effective for metal fittings for parts, led by various sensors used in internal combustion engines, and also for those required to have heat resistance and corrosion resistance (rust preventive property).

What is claimed is:

1. In a spark plug including a metal shell and a threaded portion adapted to threadedly secure the spark plug to an engine head of an internal combustion engine, the metal shell and the threaded portion each having an outer surface, the improvement comprising a heat-resistant and corrosion-resistant surface on the outer surface of the metal shell, said heat-resistant and corrosion-resistant surface comprising a layer of nickel plating on said outside surface of the metal shell and an electrolytic chromate film formed over said layer of nickel plating.

2. The spark plug as claimed in claim 1, wherein said metal shell includes a base made of steel defining a portion of said outer surface of the metal shell.

3. The spark plug as claimed in claim 1, wherein the layer of nickel plating has a thickness in the range of from 3 μm to 8 μm and the chromate film has a thickness not greater than 3 μm.

4. The spark plug as claimed in claim 3, wherein said heat-resistant and corrosion-resistant surface is also on the outer surface of the threaded portion.

5. The spark plug as claimed in claim 1, wherein the chromate film has a color imparted upon its formation by an electrolytic chromate treatment.

6. The spark plug as claimed in claim 1, wherein the chromate film has a thickness of 0.1 t 2 μm.

7. The spark plug as claimed in claim 1, wherein the layer of nickel plating has a thickness in the range of 3 μm to 8 μm.

* * * * *